United States Patent [19]

Sakai et al.

[11] Patent Number: 5,062,554

[45] Date of Patent: Nov. 5, 1991

[54] SLIDING NOZZLE DEVICE

[75] Inventors: Hiroshi Sakai; Masamichi Asai, both of Kariya; Kenzo Hayashi, Okazaki; Kazunori Sakurai, Wakayama; Kazuhiko Watanabe, Kariya, all of Japan

[73] Assignee: Toshiba Ceramics Co., Ltd., Tokyo, Japan

[21] Appl. No.: 662,514

[22] Filed: Feb. 28, 1991

Related U.S. Application Data

[63] Continuation of Ser. No. 444,974, Dec. 4, 1989, abandoned.

[30] Foreign Application Priority Data

Feb. 13, 1989 [JP] Japan ..... 1-33163

[51] Int. Cl.[5] ..... B22D 41/08

[52] U.S. Cl. ..... 222/600; 222/606; 266/236

[58] Field of Search ..... 222/597, 591, 600, 606, 222/607; 266/236, 287

[56] References Cited

U.S. PATENT DOCUMENTS 4,265,379 5/1981 Meier ..... 222/600

4,508,324 4/1985 Lührsen et al. ..... 222/600

*Primary Examiner*—S. Kastler

*Attorney, Agent, or Firm*—Oblon, Spivak, McClelland, Maier & Neustadt

[57] ABSTRACT

A sliding nozzle device comprises a metallic case having an opening in the center thereof, a refractory plate secured to the metallic case and having a discharge hole formed in the center thereof for discharging molten metal, a metallic hoop located around the refractory plate, an immersion nozzle projected from the opening of the metallic case and attached to the refractory plate, projecting plates located around the refractory plate, and bolts and nuts used for securing the projecting plates to the metallic case.

6 Claims, 5 Drawing Sheets

SLIDING NOZZLE DEVICE

This application is a continuation of application Ser. No. 07/444,974 filed on Dec. 4, 1989, now abandoned.

BACKGROUND OF THE INVENTION

1. Field of the Invention

The present invention relates to a sliding nozzle device attached to the bottom of a molten steel container, such as a tundish, and more particularly to improvement of the fixing of both the refractory lower plate and the immersion nozzle of that sliding nozzle device.

2. Description of the Related Art

A sliding nozzle device (hereinafter referred to simply as a nozzle device) is attached to the bottom of a molten steel container, so as to control the amount of molten metal flowing out of the container. Generally, the nozzle device is made up of a fixing plate, a sliding plate, and an immersion nozzle. Alternatively, it is made up of an upper fixing plate, a sliding plate, a lower fixing plate, and an immersion nozzle.

FIG. 9 shows an example of a conventional nozzle device. (In FIG. 9, illustration of an upper fixing plate and a sliding plate is omitted for simplicity.) As is shown FIG. 9, the nozzle device comprises metallic case 1 having a tubular portion in the center thereof. Refractory plate 2 is fixed to metallic case 1. It has projection 2*a* formed in the center of the lower surface thereof. Projection 2*a* extends downward into the tubular portion of metallic case 1. Discharge hole 3 for discharging molten metal is formed in the center of refractory plate 2. Mortar 4 is interposed between metallic case 1 and refractory plate 2.

Immersion nozzle 5 is fixed to projection 2*a* of refractory plate 2. Mortar 4 is also interposed between metallic case 1 and projection 2*a* of refractory plate 2. Immersion nozzle 5 has stepped portion 5*a*, at which the outer diameter of immersion nozzle 5 is changed.

Four bolts 6 are welded to the bottom of metallic case 1. Annular push plate 7 formed of iron is provided such that the radially inside portion of its upper side is in contact with stepped portion 5*a* of immersion nozzle 5. Push plate 7 has four through-holes 8 formed at locations corresponding to four bolts 6, respectively, and bolts 6 extend via through-holes 8. Nuts 9 are threadably engaged with those portions of bolts 6 which are projected from push plate 7. When nuts 9 are tightened, the upper side of push plate 7 is pressed against stepped portion 5*a* of immersion nozzle 5, with the result that immersion nozzle 5 is firmly secured to refractory plate 2.

The conventional nozzle device mentioned above has the following problems:

(1) Refractory plate 2 is secured within case 1 by use only of mortar 4. Therefore, if immersion nozzle 5 is pressed against the bottom of refractory plate 2 too tightly, refractory plate 2 may be raised from metallic case 1, adversely affecting the parallelism between plate 2 and case 1. Since, therefore, immersion nozzle 5 cannot be tightly pressed against refractory plate 2, the sealing characteristic between plate 2 and nozzle 5 is not satisfactory.

(2) Immersion nozzle 5 is secured to refractory plate 2 by use of bolts 6, push plate 7 and nuts 8. With this construction, it may happen that bolts 6 will thermally expand during the use of the nozzle device. If bolts 6 thermally expand, the force exerted on immersion nozzle 5 by push plate 7 will be reduced, thus producing a gap between plate 2 and nozzle 5. As a result, the oxygen of the air flows into the gap, causing adverse effects, such as oxidation of nozzle 5. It should be also noted that immersion nozzle 5 cannot easily be secured to refractory plate 2 since bolts 6 have to be welded to metallic case 1 and since nozzle 5 has to be firmly pressed against plate 2 by use of push plate 7 and nuts 8.

SUMMARY OF THE INVENTION

Accordingly, the first object of the present invention is to provide a sliding nozzle device wherein stopper means is located on the peripheral walls of a refractory plate and is secured to a metallic case b fastening means, to thereby prevent a gap from being produced between the refractory plate and the metallic case.

The second object of the present invention is to provide a sliding nozzle device wherein a swelling portion is formed on the outer periphery of a lower portion of an immersion nozzle, and wherein a holder or the like is provided for the swelling portion, so as to enable the immersion nozzle to be easily secured to the refractory plate.

To achieve the first object, the present invention provides a sliding nozzle device which comprises: a metallic case having an opening in the center thereof; a refractory plate secured to the metallic case and having a discharge hole, formed in the center thereof, for discharging molten metal; a metallic hoop located around the refractory plate; an immersion nozzle projected from the opening of the metallic case and attached to the refractory plate; stopper means provided for the metallic hoop located around the refractory plate; and fastening means for securing the stopper means to the metallic case.

To achieve the second object, the present invention provides sliding nozzle device which comprises: a metallic case having an opening in the center thereof; a refractory plate secured to the metallic case and having a discharge hole, formed in the center thereof, for discharging molten metal; a metallic hoop located around the refractory plate; an immersion nozzle projected from the opening of the metallic case and attached to the refractory plate; stopper means provided for the metallic hoop located around the refractory plate; fastening means for securing the stopper means to the metallic case; a holder support member attached to the bottom of the metallic case; and a holder located in the vicinity of a swelling portion of the immersion nozzle and with the holder support member.

DETAILED DESCRIPTION OF THE PREFERRED EMBODIMENTS

One embodiment of the present invention will now be described, with reference to FIGS. 1-8.

Figure 1:
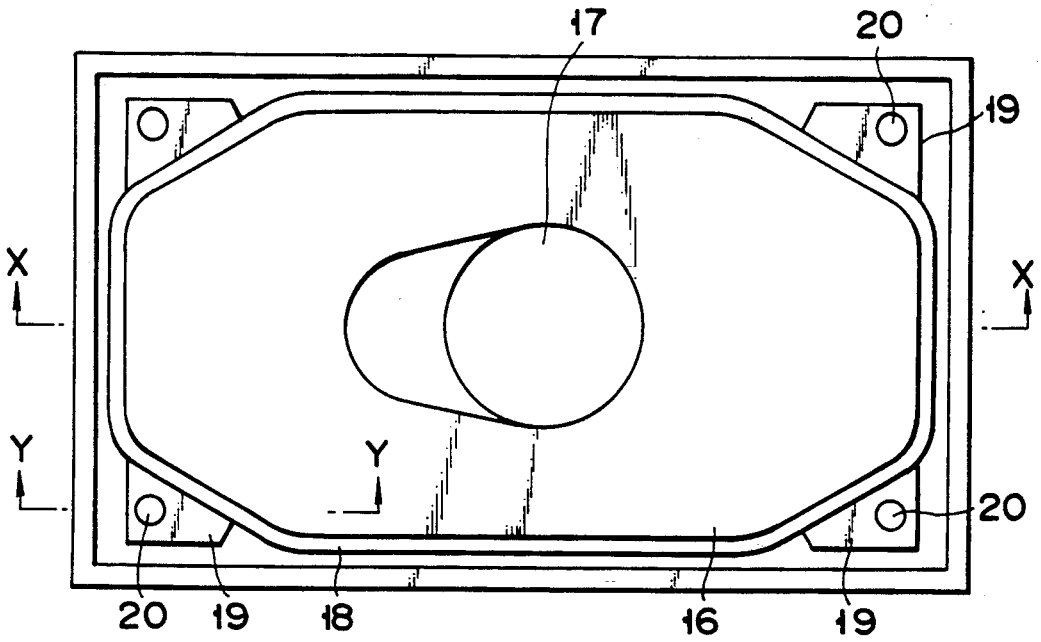
FIG. 1 is a plan view of the sliding nozzle device according to an embodiment of the present invention.
Figure 2:
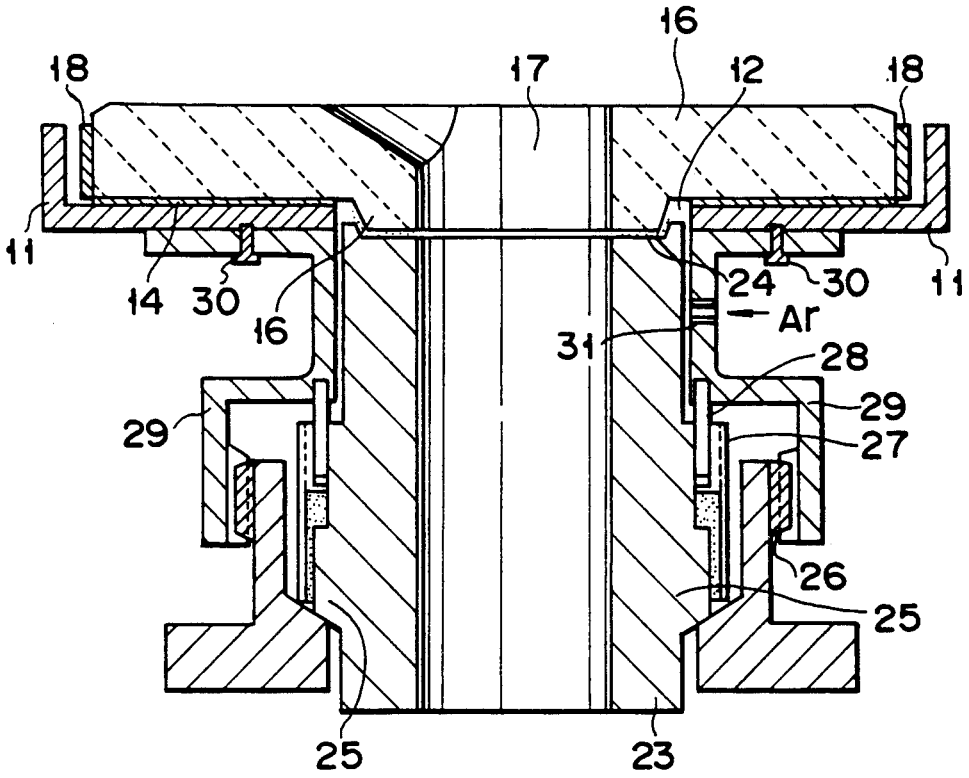
FIG. 2 is a schematic sectional view taken along line X—X in FIG. 1.
Figure 3:
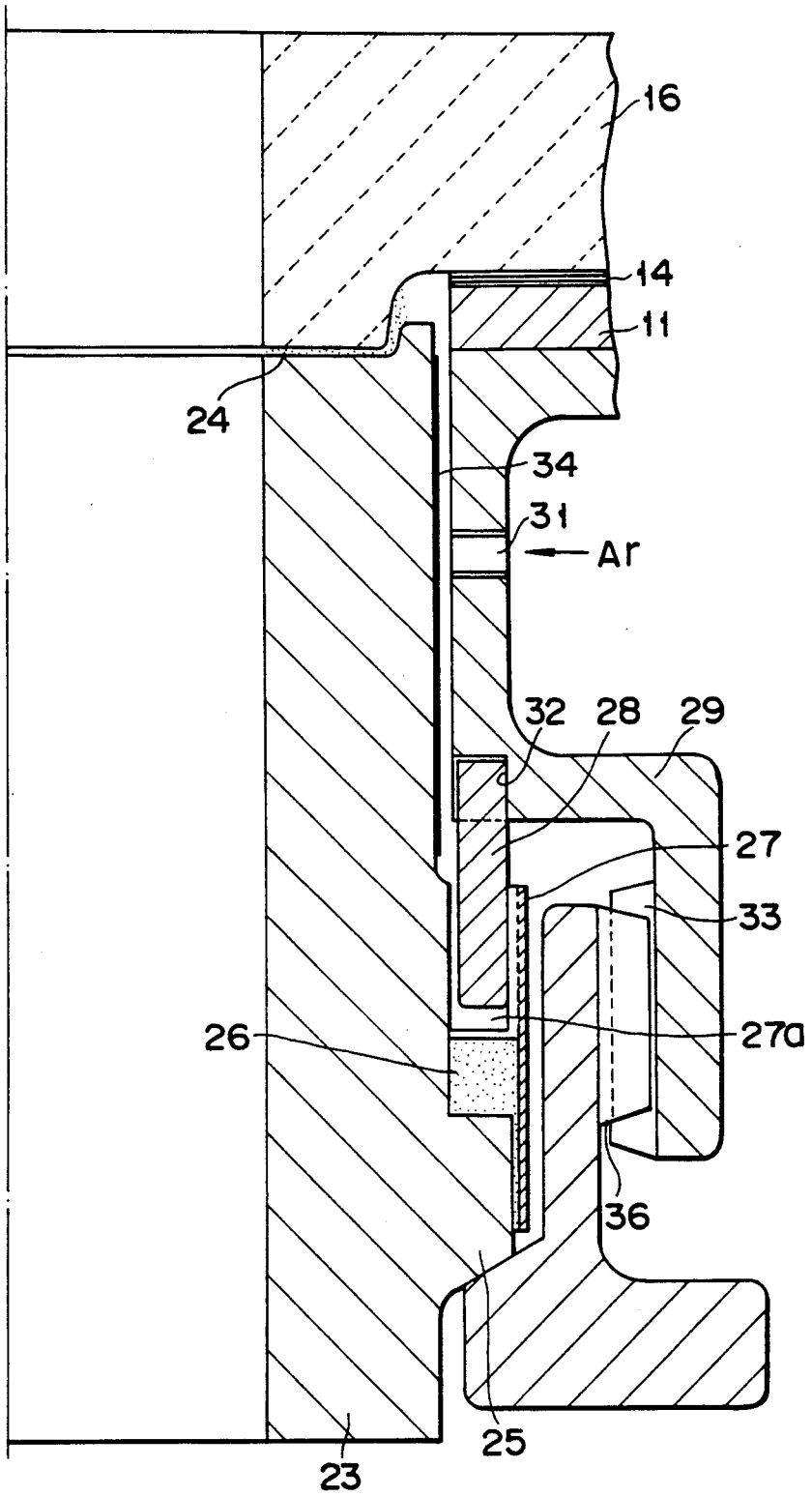
FIG. 3 is a sectional view obtained by enlarging part of FIG. 2.
Figure 4:
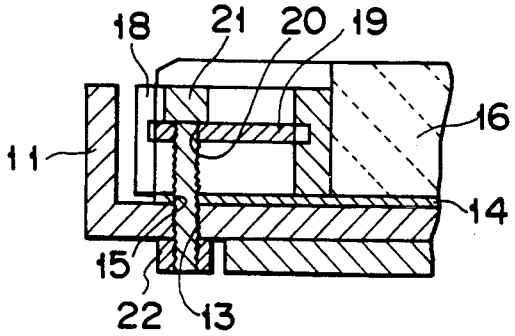
FIG. 4 is a schematic sectional view taken along line Y—Y in FIG. 1.

As is shown in the Figures, the sliding nozzle device of the embodiment comprises metallic case 11 which is shaped like a pan and which has opening 12 in the center thereof. Four first holes 13, through each of which a bolt is inserted, are formed in the respective corners of metallic case 11, as is shown in FIG. 4. A plurality of depressions (not shown), into each of which a screw is fitted, are formed in the reverse side of metallic case 11. Annular steel plate 14, obtained for example by stacking three 0.8 mm-thick steel layers upon one another, is mounted on metallic case 11. Four second holes 15, through each of which a bolt is inserted, are formed in steel plate 14 such that they correspond in location to first holes 13, as is shown in FIG. 4. Refractory plate 16 is mounted on steel plate 14. Refractory plate 16 is 420 mm in length, 170 mm in width, and 40 mm in thickness, and its four corners are cut away such that each cut-away portion has two sides which are 80 mm and 40 mm, respectively. Refractory plate 16 has projection 16*a* located in the center of the bottom thereof and extending downward. Discharge hole 17 for discharging molten metal is formed in projection 16*a* and extends in the vertical direction. Metallic hoop 18, which is in the form of a closed band, is firmly shrinkage-fitted around the peripheral side wall of refractory plate 16. Mortar may be sandwiched between metallic hoop 18 and refractory plate 16, if desired.

Four projecting plates 19 (i.e., stopper means) are welded to those portions of hoop 18 which are located in the vicinity of the four corners of refractory plate 16, respectively. They are welded to the major surface of hoop 18 and kept horizontal. Each projecting plate 19 has through-hole 20 which is formed therein such that it is aligned with the corresponding first and second holes 13 and 15. Bolt 21, which is part of fastening means, is inserted in through-hole 20 of projecting plate 19, second hole 15 of steel plate 14 and first hole 13 of metallic case 11, and the tip end of bolt 21 is projected from the reverse surface of metallic case 11. Nut 22, which constitutes the fastening means in conjunction with bolt 21, is threadably fitted around the tip end of bolt 21.

Figure 7A:
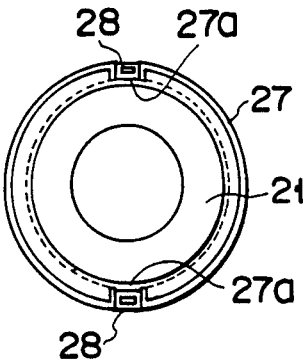
FIGS. 7A and 7B are plan and front views, respectively, of the steel band employed in the embodiment.
Figure 8A:
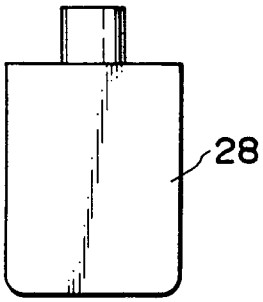
FIGS. 8A, 8B and 8C are front, side and plan views, respectively, of the positioner employed in the embodiment.
Figure 8B:
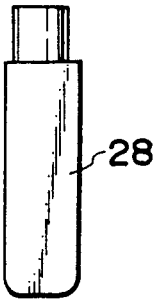
Figure 7B:
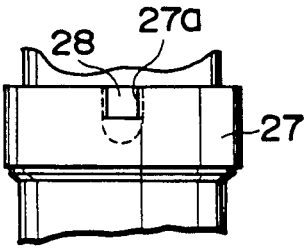
Figure 8C:
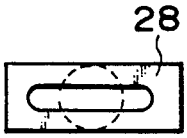
Figure 9:
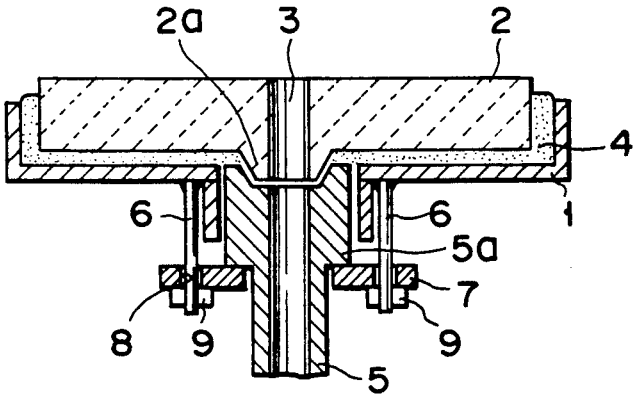
FIG. 9 is a sectional view of a conventional sliding nozzle device.

Immersion nozzle 23 is attached to the lower surface of projection 16*a* of refractory plate 16 by use of bonding mortar 24. Bonding mortar 24 may be replaced with an inorganic fiber sheet, if so desired. Immersion nozzle 23 has swelling portion 25 formed along the outer periphery of a lower portion thereof. Mortar layer 26 is formed around swelling portion 25 of immersion nozzle 23. This mortar layer 26 may be replaced with a layer formed of both mortar and inorganic fibers. Steel band 27, which is wider than mortar layer 26, is located around mortar layer 26. The lower edge of steel band 27 is at the same level as that of mortar layer 26, while the upper edge thereof is at a higher level than that of mortar layer 26. As is shown in FIGS. 7A and 7B, the upper portion of steel band 27 is partly bent inward in such as manner as to constitute notches 27*a*, and the lower end of positioner 28 is fitted in each notch 27*a*. As is shown in FIGS. 8A, 8B and 8C, positioner 28 is in the form of a rectangular parallelepiped.

Figure 5:
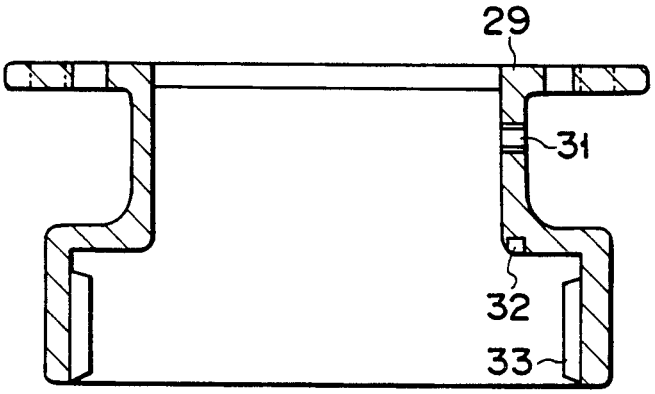
FIG. 5 is a sectional view of the holder support member employed in the embodiment.

Holder support member 29, a cross section of which is shown in FIG. 5, is fixed to the bottom of metallic case 11 by use of a plurality of screws 30. Holder support member 29 has gas-introducing port 31, which is formed in an upper portion thereof for introducing Ar gas. To receive the upper end portion of positioner 28, hollow section 32 is formed in holder support member 29 such that it extends in the axial direction of immersion nozzle 23. First threaded surface 33 is formed on the inner peripheral wall of a lower portion of holder support member 29. Insulating sheet 34 is provided on the outer peripheral surface of the upper end portion of immersion nozzle 23 in such a manner that it is located in the vicinity of gas-introducing port 31 (See FIG. 3).

Figure 6:
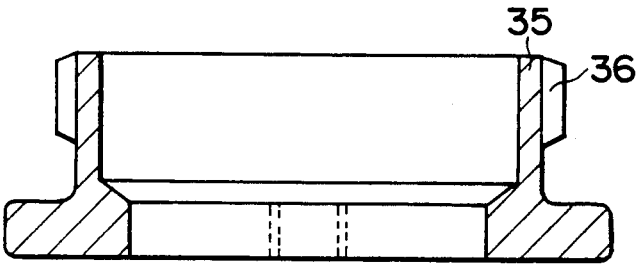
FIG. 6 is a sectional view of the holder employed in the embodiment.

Holder 35, the shape of which is best shown in FIG. 6, is located around swelling portion 25 of immersion nozzle 23. Second threaded surface 36, which threadably engages with first threaded surface 33, is formed on the outer peripheral wall of an upper portion of holder 35. Part of the inner surface of holder 35 is in contact with a lower portion of swelling portion 25 of immersion nozzle 23. Holder 35 is tightened up with a hammer or the like if it becomes loose during the use of the nozzle device as a result of thermal expansion of metallic components, such as case 11 and band 27.

The nozzle device of the above-mentioned embodiment has the following advantages:

(1) In the above-mentioned embodiment, projecting plates 19 are fixed to metallic hoop 18 located around the peripheral side wall of refractory plate 16. Further, metallic case 11 on which refractory plate 16 is mounted, steel plate 14 and projecting plates 19 are united by use of bolts 21 and nuts 22. With this structure, refractory plate 16 can be firmly secured to metallic case 11 by tightening bolts 21 and nuts 22 relative to each other. Therefore, refractory plate 16 is prevented from being raised from metallic case 11 when immersion nozzle 23 is attached to refractory plate 16. As a result, a satisfactory sealing characteristic can be obtained between immersion nozzle 23 and refractory plate 16. Thus, molten steel is prevented from penetrating refractory plate 16 or from leaking therefrom.

(2) In the above embodiment, holder support member 29 is fixed to the bottom of metallic case 11 by use of screws 30, and mortar layer 26 and steel band 27 are provided in the vicinity of swelling portion 25 of immersion nozzle 23. Positioner 28 is provided such that its upper end portion is received in hollow section 32 of holder support member 29 and its lower end is fitted in notches 27*a* of band 27. Further, holder 35, which threadably engages with holder support member 29, is located around swelling portion 25 of immersion nozzle 23. With this structure, if holder 35 is rotated, with its second threaded surface 36 engaged with first threaded surface 33 of holder support member 29, part of the inner surface of holder 35 pushes up swelling portion 25 of immersion nozzle 23. Since, therefore, immersion nozzle 23 can be raised by merely rotating holder 35, it is easy to attach immersion nozzle 23 to refractory plate 16. In addition, since immersion nozzle 23 can be firmly secured to refractory plate 16, the sealing characteristic between immersion nozzle 23 and refractory plate 16 can be further improved.

(3) In general, metallic components, such as case 11 and band 27, are likely to thermally expand during the use of the nozzle device, so that a gap may be produced between refractory plate 16 and immersion nozzle 23. In the present invention, however, such a gap can be easily eliminated by further tightening bolts 21 and nuts 22 relative to each other or by further rotating holder 35. Moreover, Ar gas is introduced into the region inside holder support member 29 through gas-introducing port 31. Therefore, even if a gap is produced, adverse effects due to the oxygen of the air can be suppressed.

(4) In the above embodiment, steel band 27 is located around swelling portion 25 of immersion nozzle 23, and notches *27a* are formed by partly bending band 27 inwardly. Further, positioner 28 is provided such that its upper end portion is received in hollow section 32 of holder support member 29 and its lower end is fitted in notches *27a* of band 27. With this structure, immersion nozzle 23 can be positioned reliably.

Figure 10:
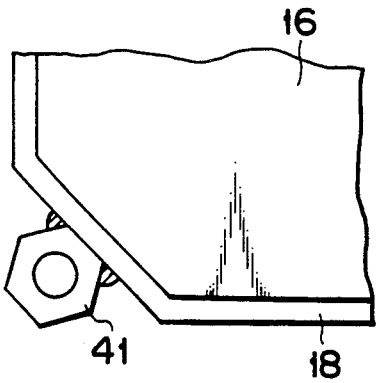
FIG. 10 is a plan view showing a first modification of the embodiment.

In the above-mentioned embodiment, the refractory plate is fixed to the metallic case by providing projecting plates to the metallic hoop and using bolts and nuts. However, the refractory plate need not be fixed in this fashion. For example, the following alternative means are available:

(1Nuts 41 (i.e., stopper means) are welded to those portions of metallic hoop 18 which are located in the vicinity of the four corners of refractory plate 16, respectively. Bolts (not shown) are fitted into nuts 41 from the reverse side of metallic hoop 18. (See FIG. 10)

Figure 11A:
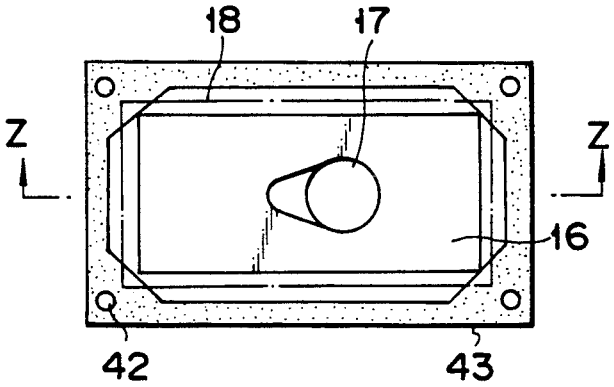
FIGS. 11A and 11B show a second modification of the embodiment, FIG. 11A being a plan view and FIG. 11B being a sectional view taken along line Z—Z in FIG. 11A.
Figure 11B:
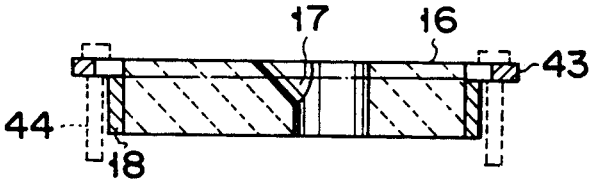

(2) Metallic hoop 18 whose upper surface is at a lower level than that of refractory plate 16 is employed, and frame 43 (i.e., stopper means) having through-holes 42 at the respective corners is mounted on hoop 18. Bolts 44 are fitted into throuh-holes 42 of frame 43, and nuts (not shown) are threadably fitted around bolts 44 and tightened. (See FIGS. 11A and 11B)

Figure 11C:
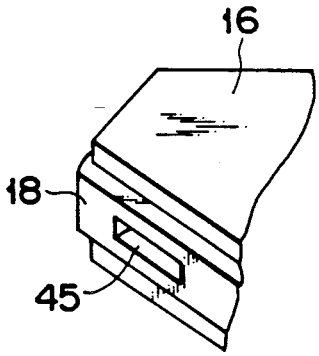
FIG. 11C shows a third modification of thc embodiment.

(3) Openings 45 are formed in those portions of metallic hoop 18 which are located in the vicinity of the four corners of refractory plate 16, respectively. A bolt (not shown) shaped like an inverted "L" and having a threaded lower portion is provided. With the upper portion engaged with each opening 45, a nut is threadably fitted around the threaded lower portion of the bolt and tightened. (See FIG. 11C)

In the above-mentioned embodiment, the threaded surfaces are formed where the holder and the holder support member contact each other, and the immersion nozzle is fixed to the refractory plate by utilization of the engagement between the threaded surface of the holder and that of the holder support member. However, the immersion nozzle need not be fixed in this fashion. For example, it may be fixed to the refractory plate by linking the holder and the holder support member together by use of a bayonet, a cotter, or the like.

What is claimed is:

1. A sliding nozzle device comprising:

a metallic case having an opening at its central area;

a refractory plate secured to the metallic case and having a discharge hole at its central area to allow a molten metal to be discharged, said refractory plate being disposed in the opening of the metallic case;

a metallic hoop wound around an outer periphery of the refractory plate;

an immersion nozzle mounted on the refractory plate and having a swollen region along an outer periphery of a lower portion thereof;

a female member outwardly projecting in a direction perpendicular to an outer surface of the metallic hoop;

fastening means for fixing the female member to the metallic case under an action of a vertical force;

a holder support member fixed to the bottom of the metallic case; and a holder provided near the swollen region of the immersion nozzle in a manner to be fitted into the holder support member.

2. The sliding nozzle device according to claim 1, wherein said female member is made up of a projecting plate having vertical through holes and said fastening means is comprised of bolts inserted into the vertical through holes and nuts threadably inserted over the bolts, respectively.

3. The sliding nozzle device according to claim 1, wherein said female member has openings opened in the outer surface of the metallic hoop and said fastening means is comprised of bolts having one end portion shaped like an inverted L for engagement with the opening and other end portion threaded and nuts engaged with the bolt.

4. The sliding nozzle device according to claim 1, wherein a metallic band has a pair of inwardly recessed notches at its upper end and a pair of positioners located in the recessed notches for positioning.

5. The sliding nozzle device according to claim 1, wherein a gas introducing hole is provided in a side wall of said holder support member.

6. The sliding nozzle device according to claim 1, wherein a first threaded surface is provided on a lower portion of an inner wall of the holder support member and a second threaded surface is provided on an upper portion of an outer periphery of the holder and threadably engaged with the first threaded surface.

* * * * *